United States Patent [19]

Francis

[11] Patent Number: 4,716,402

[45] Date of Patent: Dec. 29, 1987

[54] MODULAR PERSONAL SECURITY DEVICE

[76] Inventor: Paul S. Francis, 4603 Homestead Dr., Prarie Village, Kans. 66208

[21] Appl. No.: 796,991

[22] Filed: Nov. 12, 1985

[51] Int. Cl.[4] ..... G08B 19/00

[52] U.S. Cl. ..... 340/693; 340/546; 340/321

[58] Field of Search ..... 340/693, 546, 573, 574, 340/321; 42/1.09, 1.13; 109/20

[56] References Cited

U.S. PATENT DOCUMENTS

| | | | |
|---|---|---|---|
| 3,171,109 | 2/1965 | Appel | 340/594 |
| 3,261,010 | 7/1966 | Kardel | 340/546 |
| 4,139,845 | 2/1979 | Washburn | 340/546 |
| 4,258,359 | 3/1981 | McLamb | 340/693 |
| 4,284,982 | 8/1981 | Downey | 340/693 |
| 4,321,591 | 3/1982 | Vieweg | 340/546 |
| 4,438,428 | 3/1984 | Ober et al. | 340/546 |
| 4,484,181 | 11/1984 | Schwartz | 340/546 |
| 4,525,703 | 6/1985 | Bellino | 340/628 |
| 4,533,904 | 8/1985 | Steinman | 340/521 |
| 4,633,232 | 12/1986 | Nelson et al. | 340/542 |

FOREIGN PATENT DOCUMENTS

| | | | |
|---|---|---|---|
| 0077945 | 10/1982 | European Pat. Off. | 42/1.09 |
| 1382833 | 2/1975 | United Kingdom | 340/321 |
| 2042230 | 1/1980 | United Kingdom | 340/546 |

*Primary Examiner*—James L. Rowland
*Assistant Examiner*—Brian R. Tumm
*Attorney, Agent, or Firm*—Kokjer, Kircher, Bradley, Wharton, Bowman & Johnson

[57] ABSTRACT

A personal security device having modular components that can be assembled in various configurations and combinations to perform a wide variety of security functions. A battery powered main alarm unit can be carried on the person and includes a pull out pin for activating a flashing light and audible alarm siren in the event of an assault, a slide switch may be activated for a flashlight mode. A chemical spray component attaches to the alarm unit and can be used with it or alone. A mounting unit which can be connected to the alarm unit with or without other components mounts on a door or wall and activates the alarm unit when a break in occurs. Other components include a smoke detector and a motion detector which activate the alarm unit in the event of fire or motion indicative of an intrusion. The modular construction provides the versatility necessary to meet whatever security needs are expected, and it also allows all components to use the battery and the audible and visible alarms in the main alarm unit.

19 Claims, 8 Drawing Figures

Fig. 4.
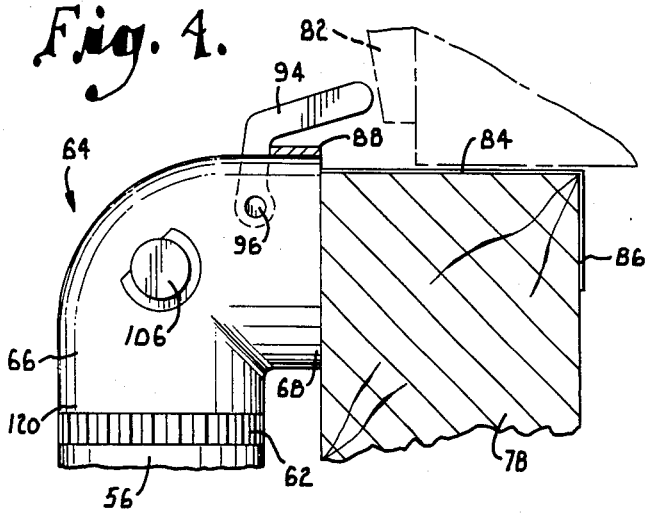
Fig. 5.
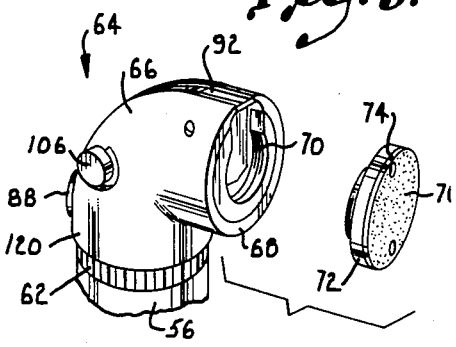
Fig. 6.
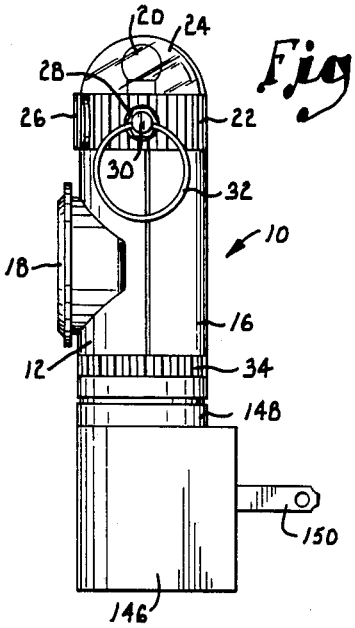
Fig. 7.
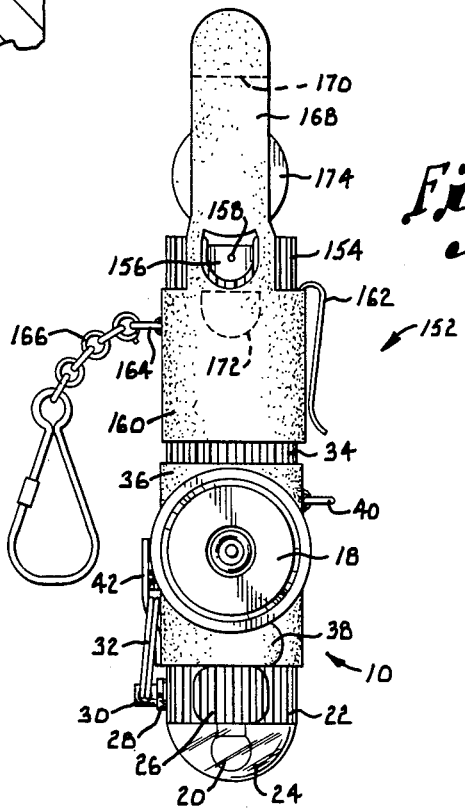
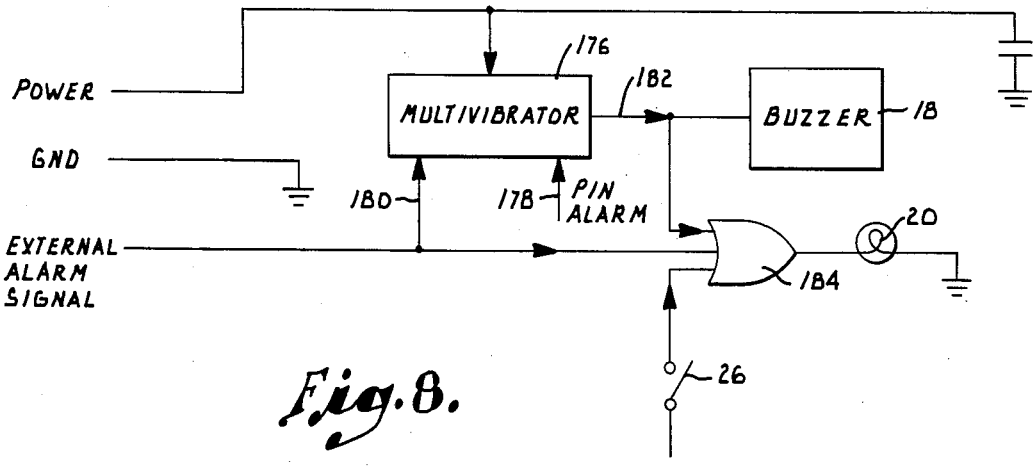
Fig. 8.

MODULAR PERSONAL SECURITY DEVICE

BACKGROUND OF THE INVENTION

This invention relates in general to the field of personal security and deals more particularly with a versatile device having modular components which are effective in protecting against assaults, burglaries and other intrusions, and fire.

In recent years, the increasing emphasis that has been placed on personal security and safety has led to the development of various types of smoke alarms, intrusion alarms, chemical spray devices and other products intended to enhance personal safety. For example, intrusion alarms and smoke alarms which can be applied to an apartment or hotel room door have been proposed, as exemplified by the devices shown in U.S. Pat. Nos. 4,438,428 to Ober; 4,533,904 to Steinman; 4,525,703 to Bellino; 4,484,181 to Schwartz; and 3,261,010 to Kardel. Other devices that have been proposed combine the functions of a flashlight and a personal distress alarm, as exemplified by the units, shown in U.S. Pat. Nos. 4,139,845 to Washburn and 3,171,109 to Appel.

These devices are all subject to a number of practical problems which have detracted from their acceptance. In addition, all known devices are lacking in versatility in that they perform only one or two specified functions and are not able to meet other personal security needs that may arise. Devices which are burglar alarms and/or smoke alarms operate in a satisfactory manner to perform these functions, but they afford no security when the occupant of an apartment or hotel room is out of the room. Thus, an apartment resident whose apartment is made secure by an intrusion alarm and/or a smoke alarm is subject to possible assault while walking, jogging or engaging in other activity where the intrusion or smoke alarms are not intended to provide security. Conversely, distress alarms which are carried on the person do not provide security against break ins or fire.

Distress alarms that are intended to be carried on the person are also unsatisfactory in a number of important respects. They are generally carried inside of a purse or at another somewhat inaccessible location where they cannot be quickly reached and activated when an emergency such as an assault on the person suddenly arises. Moreover, they are typically push button activated devices which can be easily disarmed by an assailant before they have been activated long enough to attract the attention of others.

SUMMARY OF THE INVENTION

The present invention is directed to a personal security device which is improved in a number of important respects compared to the devices that have been available in the past. The modular construction of the device is a particularly important feature because it allows the device to be assembled into various configurations that are "customized" to meet whatever security needs are expected to be encountered. The alarm and flashlight unit is constructed in a unique manner which prevents it from being disarmed by an assailant, and this important feature makes the alarm unit especially effective in warding off would be assailants.

In accordance with the invention, a number of modular components are provided, and they can be used in a wide variety of combinations which can be "custom tailored" to meet virtually any security need. The device includes a battery powered alarm unit which serves both as a flashlight and as a personal distress alarm that can be activated to emit a flashing light and a high frequency siren. The alarm unit may be carried alone and can be clipped onto a belt, waistband, purse, coat pocket or elsewhere at a readily accessible location so that it can be quickly reached and activated when necessary.

It is an important feature of the invention that the alarm unit is activated by pulling a pin which must be reinserted before the alarm signals are discontinued. Consequently, the user can pull the pin and throw it to the ground in the event of an assault or other emergency, and an assailant cannot deactivate the alarm because he is not able to locate and reinsert the pin even in the unlikely event that he is aware that this will silence the alarm.

A chemical spray component includes a canister containing a liquid chemical that can be sprayed on an assailant to discourage an attack. The spray device has a convenient belt clip and can be used alone or together with the personal alarm. When the chemical spray canister and the alarm unit are used together, they provide both offensive and defensive protection against personal attacks.

For security against unauthorized entry into a home, apartment, dormitory, or hotel or motel room, a mounting unit is provided for the alarm. The mounting unit can be hooked on top of a door or mounted to a wall or other surface if desired, and the alarm unit connects with it physically and electrically. The mounting unit has an intrusion detector which detects the unauthorized opening of a door or breakage of a window and causes the alarm unit to emit the alarm siren and a steady light to scare off the intruder and illuminate the doorway area.

Additional components of the device include a smoke detector and a motion detector. Both may be connected electrically and physically between the alarm unit and mounting unit and they can be used alone or together. If smoke is detected by the smoke detector or if motion indicative of an intrusion is detected by the motion detector the alarm siren is sounded and the light comes on steady to provide illumination for escape from the fire or illumination of the intruder.

By virtue of the modular construction of the security device, its components can be assembled in a wide variety of configurations selected to fit the particular situation that is involved at a given time. For example, when walking or jogging, only the alarm unit and/or the chemical spray canister are needed, and they can be used either alone or together. The smoke alarm motion detector and mounting unit can be detached and stored until needed. or these components need not be obtained at all if their functions are not wanted. Conversely the device can be assembled in a configuration to serve as an intrusion alarm which can be door or wall mounted and which can be used with or without the smoke alarm and motion detector. The device thus has the flexibility and versatility to meet whatever security needs are expected to be encountered in various situations, particularly when travelling away from home.

DESCRIPTION OF THE DRAWINGS

In the accompanying drawings which form a part of the specification and are to be read in conjunction therewith and in which like reference numerals are used to indicate like parts in the various views:

FIG. 4 is a side elevational view similar to FIG. 3, but showing the intrusion alarm in the triggered condition in response to opening of the door;

FIG. 5 is a fragmentary perspective view showing the mounting unit and the disk which may be optionally used for mounting of the unit on a wall or other surface in a semi-permanent installation;

FIG. 6 is an elevational view showing the alarm and flashlight unit applied to a battery charger;

FIG. 7 is an elevational view showing the chemical spray unit installed on the alarm unit, with the safety for the alarm pin applied and the safety for the spray button released; and FIG. 8 is a functional block diagram of the electrical circuit for the security device.

DETAILED DESCRIPTION OF THE INVENTION

Figure 1:
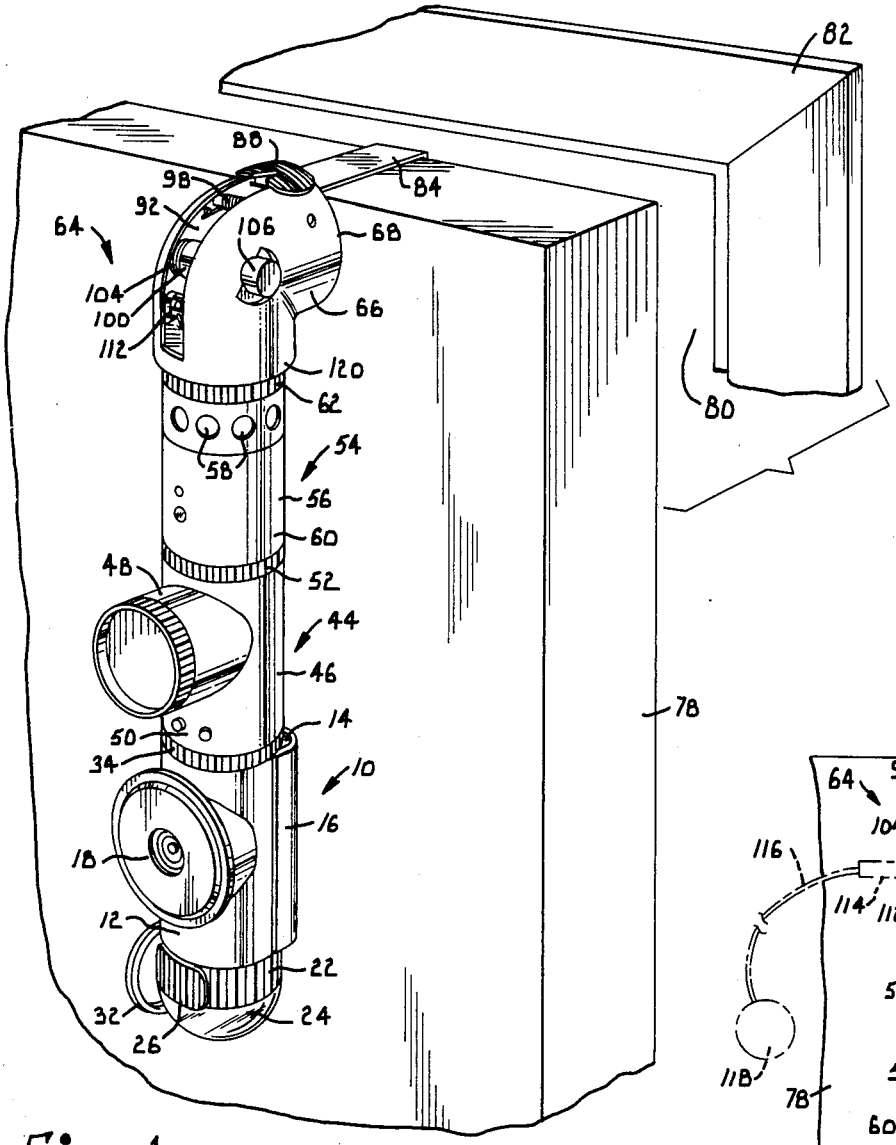
FIG. 1 is a perspective view showing the security device of the present invention mounted on a door and arranged to serve as a smoke detector and intrusion and motion detector, with the mounting component intrusion detector in its disarmed condition.

Referring now to the drawings in more detail, the present invention is directed to a personal security device which includes a number of modular components, including a main alarm unit which is generally designated by numeral 10. The alarm unit 10 serves as both a flashlight and a personal distress alarm, and it includes a generally cylindrical housing 12 which may be formed from ABS plastic or another suitable material. A rechargeable or alkaline battery 14, which may be a 9 volt battery, is carried within the housing 12 and is accessible by removing a snap on cover 16. The battery 14 supplies electrical power for operating a buzzer 18 located on the side of housing 12 opposite the battery cover 16. When the buzzer 18 is energized, it emits a high frequency alarm siren. The battery 14 also supplies electrical power for operating a small lightbulb 20 located on one end 22 of the housing 12. A dome shaped transparent lens 24 is secured to end 22 of the housing and covers the bulb 20. A slide switch 26 for the flashlight function is operated manually to energize bulb 20 in the on position of the switch and to maintain the bulb deenergized when the switch is in the off position.

The housing 12 is provided near end 22 with a small socket 28 which is best shown in FIG. 6. Fitted in the socket 28 is an alarm pin 30 which may be pulled out of the socket to activate the alarm feature of unit 10. Pin 30 has an enlarged head on its outer end to which a ring 32 is attached in order to facilitate pulling of the pin from socket 28. The ring 32 is large enough to easily receive a finger.

Housing 12 has a knurled end 34 opposite end 22. The knurled end 34 is constructed in a manner to be connected physically and electrically with the other components of the security device, as will be described more fully.

Referring now to FIG. 7 in particular, a flexible vest 36 may be applied to substantially cover the housing 12 of the main alarm unit. The vest 36 takes the form of a sleeve having a cut out through which the buzzer 18 projects. A strap 38 extends between the buzzer 18 and the flashlight slide switch 26, and the end of the strap may be detachably secured to the main body of the vest 36 by hook and loop fasteners (not shown) or another releaseable fastening means. When the vest 36 is secured in place on housing 12, it leaves end 22 exposed, including the bulb 20, the slide switch 26 and the pin 30. A small ring 40 projects from the vest 36 and is suitable for receiving a key chain. The vest 36 may be constructed of vinyl, leather or any other suitable material having adequate flexibility.

With continued reference to FIG. 7, a safety strap 42 extends from vest 36 and is secured to the vest at one end. The safety strap 42 is located adjacent to ring 32 and may be extended through the ring. Strap 42 has a free end which may be detachably secured to the main body of vest 36 by hook and loop fasteners (not shown) or another releaseable fastening means. When strap 42 is looped through ring 32 and its free end is secured to the body of vest 36, the safety is engaged and acts to hold ring 32 against the vest to thereby prevent pin 30 from being accidentally pulled out of its socket 28. To release the safety strap 32, its free end is detached from the body of vest 36, and ring 32 is then free so that the alarm pin 30 can be pulled.

Referring again to FIGS. 1 and 2, another modular component included in the security device is a motion detector which is generally designated by numeral 44. The motion detector 44 has a rigid cylindrical housing 46 which may be constructed of ABS plastic or another suitable material. A tube 48 projects from one side of the housing 46 and may be aimed at the location which is to be monitored for motion. Tube 48 may be aimed at a door, window or other area which is to be monitored for an intrusion, and any motion that occurs within the area that is being monitored is detected by a conventional electrically powered motion detecting system in the housing 46 of the motion detector. The housing 46 has one end 50 which is constructed to be detachably connected with end 34 of the main alarm unit 10, as will be described in more detail. The opposite end 52 of housing 46 is a knurled end which is similar to the knurled end 34 of the main alarm unit and which may be physically and electrically connected to additional components.

When the motion detector 44 is connected with the main alarm unit 10, the electrical connection between ends 34 and 50 makes power from the battery 14 available to operate the detecting system of the motion detector. When motion is detected, an electrical motion signal is applied by the motion detecting system to end 50 of the housing and then to end 34 of the alarm unit housing. The opposite ends 50 and 52 of the motion detector 44 are electrically connected so that the components on opposite ends of the motion detector are electrically connected. The motion detecting circuitry is battery powered and requires power from the battery 14 to operate.

Another modular component included in the security device is a smoke detector generally designated by numeral 54. The smoke detector 54 has a rigid cylindrical housing 56 which is provided with a series of openings 58 through which smoke in the ambient environment may pass. Within housing 56, the smoke detector carries a conventional smoke detecting system which senses the presence of smoke and generates an electrical signal when smoke is detected. The smoke detecting system may be an optical system, an ionization system, or any other suitable system. Alternatively, the unit 54 may include heat sensors or other devices which operate to detect the presence of fire and generate an output signal when fire is sensed.

Housing 56 has one end 60 which is constructed to be physically and electrically attached to the knurled end 34 of the main alarm unit 10 or the knurled end 52 of the motion detector 44. The opposite end 62 of housing 56 is a knurled end which is constructed in substantially the same manner as the knurled ends 34 and 52. The opposite ends 60 and 62 of the smoke detector are electrically connected in order to transmit electrical signals through the smoke detector. The smoke detecting circuitry is battery powered and requires electrical power from the battery 14 and the main alarm unit.

A mounting unit 64 forms an additional modular component of the security device. The mounting unit 64 acts to mount the security device on a door, wall or another surface, and it also serves as an intrusion alarm which senses an unauthorized entry and provides a suitable alarm signal. The mounting unit 64 has a rigid L-shaped housing 66 which may be constructed of ABS plastic or another suitable material. One end 68 of housing 66 has an internally threaded opening 70 (see FIG. 5) to which a rigid disk 72 may be threaded. The outer face of disk 72 carries an adhesive pad 74 which is covered by a detachable cover strip 76. When the cover strip 76 is peeled away from the pad 74, the pad can be applied to a wall, ceiling, door casing or other supporting surface in order to mount the security device in a permanent or semi-permanent manner to the supporting surface.

Figure 3:
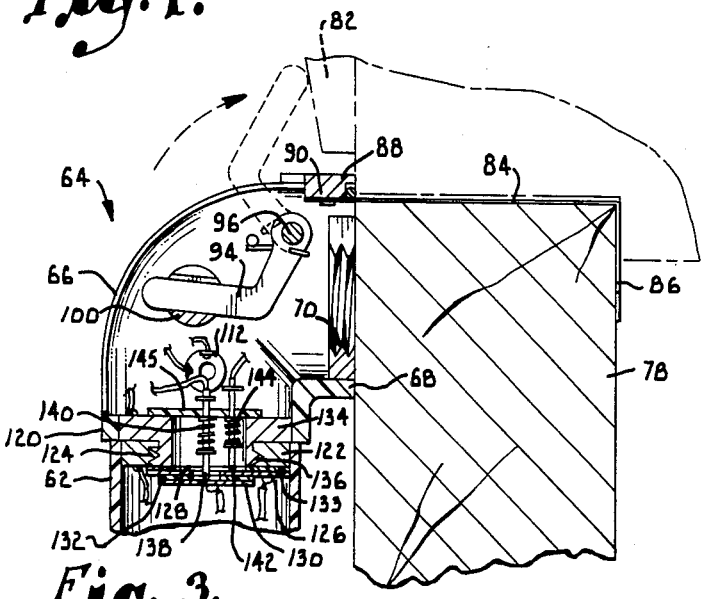
FIG. 3 is a fragmentary sectional view on an enlarged scale taken generally along line 3—3 of FIG. 2 in the direction of the arrows, with the broken lines showing the activating lever for the intrusion alarm in its armed condition.

Alternatively, the mounting unit 64 can be mounted on the upper edge of a door 78 which closes a doorway 80 having a surrounding frame 82. An extensible and retractable bracket 84 carries a downturned flange 86 on one end and is secured to a slide 88 at the opposite end. The bracket 84 and slide 88 are connected by a guide block 90 which fits closely through a slot 92 formed in housing 66 and which serves as an electrical contact as will be explained more fully. Slide 88 may be moved by the thumb toward the lower end of slot 92, and this causes bracket 84 to retract into the housing 66. When slide 88 is moved in the opposite direction, slide 84 is extended out of the housing and may be extended far enough to hook over the top edge of the door 78, with flange 68 engaging the outer door surface as shown in FIGS. 3 and 4. This temporarily secures the mounting unit 64 and all components attached to it to the door 78. When not in use, the mounting unit 64 can be removed from the door and bracket 84 can be retracted into the housing.

The intrusion detecting system of the mounting unit 64 includes an L-shaped lever 94 which is mounted to pivot on a cross pin 96 located within housing 64 adjacent to end 68. A torsion spring 98 is coiled around pin 96 and acts on lever 94 in a direction to continuously urge the lever to rotate in a clockwise direction as viewed in FIG. 3 from the retracted position shown in broken lines toward an extended position wherein the lever projects out of the housing through slot 92.

A horizontal pin 100 extends in housing 64 and is provided with a notch 102 which normally holds lever 94 in the retracted position. A compression spring 104 acts against pin 100 to urge it to the right as viewed in FIG. 2 to maintain lever 94 engaged in the slot 102. The opposite or right end of pin 100 projects through the wall of housing 64 to provide a button 106 which may be depressed to move pin 100 axially against the force of spring 104. This movement of pin 100 releases lever 94 from slot 102, and the lever then moves toward its extended position under the influence of the torsion spring 98.

When the door 78 is closed and button 106 is depressed to release lever 94, the lever moves to the position shown in broken lines in FIG. 3 where its free end is engaged against the doorway frame 82. In this position, lever 94 is displaced from block 90. When the door 78 is opened, the free end of lever 94 is released from the doorway frame 82 and is moved by the torsion spring 98 to the fully extended position shown in FIG. 4. In this position, lever 94 contacts block 90 to complete the electrical circuit which results in the generation of an electrical signal indicative of an intrusion. This intrusion signal activates the alarm unit as will be explained more fully.

Figure 2:
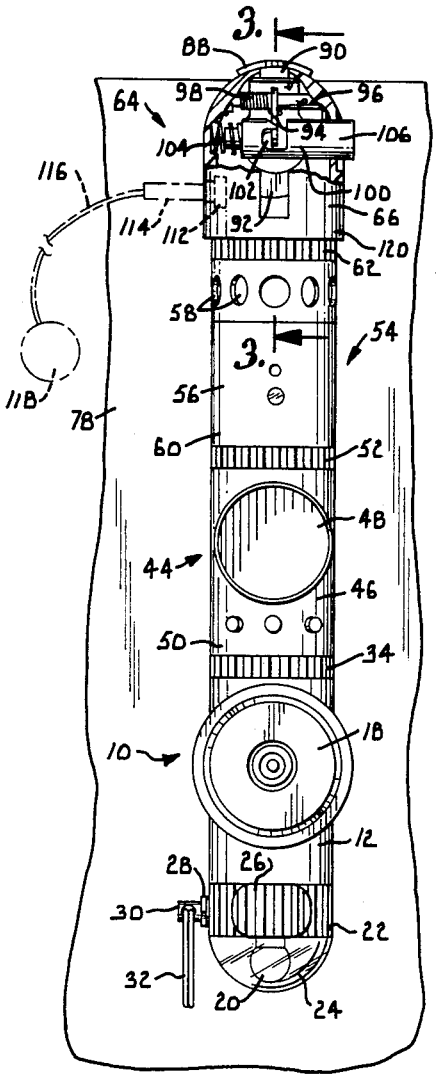
FIG. 2 is an elevational view of the arrangement shown in FIG. 1, with the intrusion alarm in its disarmed condition and a portion broken away for purposes of illustration.

As shown in FIGS. 2 and 3, a jack 112 is formed in one side of housing 64 in order to receive a small plug 114 (FIG. 2). A cord 116 extends from the plug 114 to a conventional window breakage sensor 118 which provides an electrical intrusion signal upon breaking of a window to which the sensor 118 is mounted. This intrusion signal is applied to the jack 112 and is used to activate the alarm in a manner that will be explained. A door switch (not shown) may also be carried on the end of the cord 116 in order to provide an intrusion signal upon opening of a door or window to which the switch is applied.

FIG. 3 illustrates the details of construction of the lower or connecting end 120 of the mounting unit 64, along with the manner in which end 120 connects physically and electrically with the knurled end 62 of the smoke detector 54. This manner of connection is the same for all of the components, and the ends are all constructed similarly.

As shown in FIG. 3, the knurled end 62 is provided with a rigid disk 122 having an internally threaded passage 124. A thin contact plate 126 formed of copper or another electrical conductor is located at the base of passage 124 and is provided with a small opening 128 in its center. Another contact plate 130 is spaced from plate 126 by an insulator 132. Plate 130 is aligned with the opening 128 in plate 126. An insulator 133 is sandwiched between disk 122 and plate 126.

End 120 of housing 64 is provided with a rigid disk 134 having an externally threaded sleeve 136 which may be threaded into passage 124. A pin 138 extends through the center of sleeve 136 and is urged toward an extended position by compression spring 140. The pin 138 forms an electrical contact which extends through opening 128 and contacts plate 130 when the ends 62 and 120 are threaded together. The spring 140 urges pin 138 against plate 132 to maintain electrical contact therebetween.

Another pin 142 is arranged parallel to but offset from pin 138 and is urged toward an extended position by a compression spring 144. The pins 138 and 142 extend through an insulator 145 which serves to stabilize the pins. The tip of pin 142 contacts plate 126 to establish a second electrical connection when the parts are threaded together. A third electrical connection is established between disk 122 and sleeve 136.

It is to be understood that the knurled end of each component of the security device is constructed in substantially the same manner as described for end 62 of the smoke detector, and each knurled end includes a pair of contact plates. Similarly, the other end of each component (except the main alarm unit 10) is constructed in substantially the same manner as end 120 and is provided with a pair of contact pins which establish electrical connections with plates 126 and 130 in the mating knurled end. The disks 122 and 134 are electrically isolated from the contact plates in order to establish a ground connection between components which are threaded together. It should also be noted that the opposite ends of each component are electrically connected with one another so that power from the battery 14 is applied through each component to a component which is more remote from the main alarm unit 10. At the same time, signals generated by remote components are applied to the alarm unit 10 through any intermediate components.

Referring now to FIG. 6, a battery charger 146 has one end 148 constructed in a manner to be physically and electrically connected with the knurled end 34 of the main alarm unit 10 in the same manner described in connection with FIG. 3. The battery charger also includes a pair of projecting prongs 150 which may be applied to a conventional electrical outlet. The battery 14 can be charged by threading the alarm unit 10 to end 148 of the battery charger and inserting the prongs 150 into an electrical outlet. The circuitry which makes use of the AC power to charge the battery is conventional and is located within the battery charger 146.

FIG. 7 illustrates a chemical spray unit 152 which forms another component of the security device. The spray unit 152 has a cylindrical canister 154 which may contain a suitable chemical for spraying on an assailant. The canister 154 may be recharged with a fresh supply of the chemical when it has been emptied. A button 156 is located on top of the canister and may be depressed to release the canister contents through a nozzle 158. The end of the canister opposite button 156 is constructed to be threaded into the knurled end 34 of the alarm unit, as shown in FIG. 7. The spray unit 152 does not require electrical power to operate, so it need not be electrically connected with the main alarm unit.

A flexible sleeve 160 normally covers the body of the canister 154. The sleeve 160 is provided with a belt clip 162 which may be clipped onto a belt, purse, waistband, an inside coat pocket or any other garment or accessory carried on the person. The opposite side of sleeve 162 is provided with a small ring 164 to which a key chain 166 may be attached.

The belt clip 162 may be used to clip the chemical spray unit 152 onto a garment or accessory, either alone or together with the main alarm unit 10. The vest 36 which covers the housing 12 of the main alarm unit may be equipped with a clip identical to clip 162 so that the main alarm unit alone may be clipped onto a garment or accessory.

A safety strap 168 is connected at one end with the top edge of sleeve 160 and has a free end provided with a patch 170. Another patch 172 is provided on sleeve 168. The patches 170 and 172 carry mating hook and loop fasteners. A rigid disk 174 is carried on the strap 168 and covers button 156 when the strap is secured with the patches 170 and 172 applied to one another. The disk 174 then prevents button 156 from being depressed to release the chemical spray agent. When the pads 170 and 172 are pulled apart, disk 174 is displaced from button 156 so that access for depression of button 156 is provided.

FIG. 8 is a functional block diagram of the electrical system which activates the buzzer 18 and the bulb 20. A multivibrator block 176 receives power from the battery 14. Inputs to the multivibrator come from line 178 which is activated when the pin 30 is removed from socket 28 and from line 180 which is activated when an alarm signal is generated by the intrusion detecting system of the mounting unit 64, the fire detecting system of the smoke detector 54, or the motion detecting system in the motion detector 44. The multivibrator 176 has an output line 182 which connects with the buzzer 18 and with one input of a three input OR gate 184. The second input to gate 184 comes from the alarm signal that activates line 180, and the third input is active when the slide switch 26 is closed. The output from the OR gate 184 is applied to bulb 20.

In use, the security device can be assembled in a number of different configurations depending upon the security needs that are anticipated. For example, the main alarm unit 10 can be carried on the person by itself when an individual is walking, jogging or otherwise in a situation where a personal attack may occur. The alarm unit 10 may be carried in the hand or in a purse, pocket or elsewhere either with or without the vest 36 applied. When the vest is applied, the alarm unit may be clipped onto a belt, a purse, an inside or outside coat pocket, or it may be clipped onto the waistband of jogging shorts or trousers. When carried in the hand in a particularly dangerous environment, the safety strap 42 should be released, and the finger may be placed through ring 32 so that pin 30 will be pulled by the sudden force resulting from a physical attack.

In any event, when the user is attacked or otherwise in distress, ring 32 is pulled to remove pin 30 from its socket 28. This activates line 178 and causes the output line 182 of the multivibrator 176 to oscillate. The oscillations cause the buzzer 18 to cycle on and off, and the buzzer emits a high frequency siren alarm that is interrupted each time the buzzer is deenergized. The oscillations which are applied to line 182 are also applied to the OR gate 184, and its output is thereby cycled high and low to energize and deenergize bulb 20 in succession to cause the bulb to generate a flashing light. The audible alarm and flashing light signal attract the attention of passersby and cause the assailant to flee. When pin 30 is pulled, it should be thrown to the ground as far away as possible so that it cannot be reinserted into socket 28 to deactivate the alarm. So long as the pin remains out of the socket, the audible siren and the flashing light continue, and they are not stopped even if the alarm unit 10 is thrown to the ground or otherwise subjected to excessive force.

In order to use the alarm unit 10 as a flashlight, the slide switch 26 is moved to the on position, and this activates one input to the OR gate 184. Consequently, the bulb 20 is energized steadily to emit a steady light which can be used in the manner of a flashlight. The buzzer 18 remains silent in this circumstance.

The chemical spray unit 152 can be used alone or together with the main alarm unit 10 as shown in FIG. 7. In either case, the safety strap 168 can be released and button 156 can be depressed to spray the chemical agent in the face of an assailant. This offensive action, when accompanied by the defensive deterrent effect provided by the main alarm 10, provides particularly effective protection against assaults on the person.

The occupant of a residence, apartment, dormitory or hotel room can assemble the security device in a configuration to provide an intrusion alarm and/or fire alarm. If end 120 of the mounting unit 64 is threaded directly to the knurled end 34 of the main alarm unit 10, an intrusion alarm alone is provided. The bracket 84 can be extended to temporarily mount the security device on the door 78 of an apartment or hotel or motel room without requiring any permanent alteration of the room. After the door has been closed and button 106 has been depressed to arm the intrusion detector, opening of the door results in the contacts 110 being bridged to generate an intrusion signal. This signal is applied through the contact pins 138 and 142 to the contact plates 126 and 130 located in the knurled end 34 of unit 10. Power is also available to the intrusion detector from the battery 14. When the intrusion signal is generated, it is applied to the OR gate 184 and on line 180 to the multivibrator. The constant input signal to the OR gate results in a constant output signal which energizes bulb 120 steadily to illuminate the doorway area in which the intrusion is taking place. At the same time, the oscillating signal on line 182 causes the buzzer 18 to become energized and deenergized in succession to generate a high frequency interrupted siren alarm which attracts attention and scares away the intruder.

If the adhesive pad 74 is used for mounting of unit 64 and the attached alarm unit 10, a door switch or the window breakage sensor 118 can be used to apply an intrusion signal to the jack 112 in the event of an unauthorized entry through the door or breakage of a window. This intrusion signal acts in the same manner to cause bulb 20 to be steadily energized with the accompanying siren sound generated by the successive energization and deenergization of the buzzer 18. The jack 112 can also be used when the unit is mounted on the door.

The smoke detector 54 and/or the motion detector 44 can be installed between units 10 and 64 in either a door mounted or a wall or ceiling mounted installation. Motion that occurs in the area or areas that are being monitored by the motion detector results in the generation of an electrical motion signal which is applied to the main alarm unit 10 and causes the buzzer 18 to sound a siren alarm and the bulb 20 to generate a steady light for illumination of the area.

If the smoke detector 54 is used and the presence of smoke is sensed, the smoke detecting system generates a fire signal which is applied to the main unit 10 (through the motion detector 44 if present). Again, the alarm signal causes an oscillating siren sound to be generated from the buzzer 18 and causes the bulb 20 to generate a steady light.

The modular construction of the security device makes battery power from the single battery 14 available to all of the units that are connected with the main unit 10. The battery power is applied through each unit to the next unit, and the alarm signals that may be generated are applied through each unit to the next unit and ultimately to the main alarm unit 10. Consequently, the main alarm unit may be used either alone or together with any combination of the other components. For example, the user of the complete system would carry the main alarm unit connected to the chemical spray component on his/her key chain. When returning to the hotel room, dormitory, apartment or home, the chemical spray component may be detached and placed on the night table, next to the bed, while the main alarm unit is reattached to the smoke detector and/or motion detector and mounting component which is clipped over the door or mounted on the wall or other surface. If the smoke detector component senses smoke, the alarm and light will activate. The user may then remove the unit from the illuminated exit and use the device to illuminate escape through darkened hallways and stairs to safety. If the intrusion or motion detector activates, the user will be wakened by the siren and light. While the point of entry is illuminated, the user can make use of the chemical spray component to ward off an assault.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof it is to be understood that all matter herein set forth or shown in the accompanying drawings is to be interpreted as illustrative and not in a limiting sense.

Having thus described the invention, I claim:

1. A security device for carrying on the person, said device comprising:

a housing having a size to be held in the hand;

a flashlight bulb in said housing for emitting light when energized to provide illumination of the area into which the light from the bulb is directed;

a buzzer in said housing for emitting an audible alarm signal when energized;

a battery in said housing for supplying power to said bulb and buzzer to energize same;

a switch on said housing having an off condition wherein said bulb is deenergized and an on condition wherein said bulb is energized steadily;

a socket in said housing;

a pin in said socket, said pin being removable from said socket and being accessible to be pulled out of the socket and detached from the housing;

means for successively energizing and deenergizing said bulb to emit a flashing alarm light in a response to removal of said pin from said socket;

means for successively energizing and deenergizing said buzzer to emit a series of said audible alarm signals in succession in response to removal of said pin from said socket;

a mounting unit for said housing having first and second ends, said first end of the mounting unit having means for securing same to a supporting surface and said second end being adapted for detachable physical and electrical connection to said housing in a manner to receive power from said battery;

intrusion detecting means associated with said mounting unit and powered by said battery for detecting an intrustion and applying an electrical intrusion signal to said second end when an intrusion is detected; and means for steadily energizing said bulb and successively energizing and deenergizing said buzzer when said electrical intrusion signal is applied to said housing through said second end of the mounting unit.

2. A device as set forth in claim 1, including a ring on said pin accessible when the pin is inserted in said socket.

3. A device as set forth in claim 1, including:

a flexible cover having a size to fit around said housing without covering said bulb, said cover being applicable to said housing and being removable therefrom; and releaseable means for securing said cover on said housing.

4. A device as set forth in claim 3, including a clip on said cover for clipping said housing to a garment or accessory carried on the person.

5. A device as set forth in claim 3, including means on said cover for attachment of a key chain.

6. A device as set forth in claim 3, including:

a ring on said pin accessible when the pin is inserted in said socket and said cover is applied to the housing; and a releaseable safety on said cover engageable with said ring in a manner to prevent pulling of said pin from the socket until the safety is released.

7. A device as set forth in claim 1, wherein:

said housing includes a first end to which said second end of the mounting unit is adapted for physical and electrical connection; and said housing includes a second end on which said bulb is located.

8. A device as set forth in claim 7, including:

a fire detecting unit having first and second ends electrically connected with one another, said fire detecting unit having means for detecting fire and applying an electrical fire signal to said second end of the fire detecting unit when fire is detected;

said fire detecting unit being adapted for detachable connection between said housing and said mounting unit with said second end of the fire detecting unit electrically and physically connected to said first end of the housing and said first end of the fire detecting unit physically and electrically connected to said second end of the mounting unit; and means for steadily energizing said bulb and successively energizing and deenergizing said buzzer when said fire signal is applied to said housing.

9. A device as set forth in claim 8, including:

a motion detecting unit having first and second ends electrically connected with one another, said motion detecting unit having means for detecting motion and applying an electrical motion signal to said second end of the motion detecting unit when motion is detected;

said motion detecting unit being adapted for detachable physical and electrical connection between said housing and said mounting unit in a manner to transmit electrical signals therethrough to the housing and to apply said motion signal to the housing; and means for steadily energizing said bulb and successively energizing and deenergizing said buzzer when said motion signal is applied to said housing.

10. A device as set forth in claim 1, including:

a chemical spray unit adapted for detachable connection to said housing, said chemical spray unit having a container for holding a supply of chemical and a nozzle for discharging said chemical in a spray when activated; and a button on said container for activating said nozzle upon depression of the button.

11. A device as set forth in claim 10, including a flexible sleeve applicable to said spray unit to cover said container without obstructing access to said button, said sleeve being removable from said spray unit.

12. A device as set forth in claim 11, including:

a safety strap on said sleeve having an engaged position wherein said strap covers said button to prevent depression thereof and a release position wherein the button is accessible for depression thereof; and releasable means for holding said safety strap in the engaged position.

13. A device as set forth in claim 11, including a clip on said sleeve for clipping said spray unit to a garment or accessory carried on the person.

14. A security device comprising:

an alarm unit having a housing, a flashlight bulb in the housing for emitting light to illuminate the surrounding area when energized, a buzzer in the housing for emitting an audible alarm signal when energized, a battery in the housing for supplying power for energizing the bulb and buzzer, and manually operated means on said housing for activating said alarm unit to energize said bulb and buzzer, said housing having a first end to which power is available from the battery;

a mounting unit separable from said alarm unit and having a housing and means for detecting an intrusion and generating an electrical intrusion signal when an intrusion is detected, said housing of the mounting unit having first and second ends with said second end being electrically connected with said detecting means to receive said electrical intrusion signal;

means on said first end of the housing of said mounting unit for securing same to a supporting surface;

said second end of the mounting unit housing being adapted for detachable physical and electrical connection to said first end of the alarm unit housing to make the battery available to supply power to the mounting unit and to apply said electrical intrusion signal to the alarm unit when the mounting unit is connected thereto; and means for energizing said bulb and buzzer to provide alarm signals in response to generation of said electrical signal when said alarm and mounting units are connected.

15. A device as set forth in claim 14, including:

a switch on said alarm unit housing having on and off positions; and means for energizing said bulb in the on position of the switch and deenergizing said bulb in the off position of the switch.

16. A device as set forth in claim 14, wherein said manually operated means comprises:

a socket in said housing of the alarm unit;

a pin in said socket, said pin being removable from the socket and being accessible to be manually pulled out of the socket; and means for energizing said bulb in a flashing alarm mode and simultaneously energizing said buzzer when said pin is removed from the socket.

17. A device as set forth in claim 16, including:

a switch on said alarm unit housing having on and off positions; and means for energizing said bulb in the on position of the switch and deenergizing said bulb in the off position of the switch, said means for energizing said bulb in a flashing alarm mode being operable in the off position of the switch.

18. In a modular security device, the combination of:

an alarm unit having a housing, a bulb in the housing for emitting light when energized, a buzzer in the housing for emitting an audible alarm signal when energized, a battery in the housing for supplying power to energize said bulb and buzzer, switch means for energizing said bulb steadily to illuminate the surrounding area and manually operated means for activating said bulb and buzzer in an alarm mode, said housing having a first end to which power from the battery is available;

a mounting unit separable from said alarm unit and having a housing presenting one end and a second end opposite said one end, said one end of the mounting unit housing having means for securing said mounting unit to a supporting surface;

intrusion detecting means associated with said mounting unit for detecting an intrusion and applying an electrical intrusion signal to said second end when an intrusion is detected, said intrusion detecting means being powered by said battery;

a fire detecting unit separable from said alarm and mounting unit and having a housing presenting first and second ends electrically connected with one another, said housing of the fire detecting unit having fire detecting means for detecting fire and applying an electrical fire signal to said second end of the fire detecting unit housing when fire is detected, said fire detecting means being powered by said battery;

said first end of each housing being adapted for detachable physical and electrical connection to the second end of th eother housings to make battery power available to each unit connected to the alarm unit and to apply to the alarm unit all electrical signals generated by units connected to the alarm unit; and means for energizing said bulb and buzzer to provide alarm signals in response to application of any of said electrical signals to said alarm units.

19. The combination of claim 18, including:

a motion detecting unit having a housing presenting first and second ends electrically connected with one another and motion detecting means for detecting motion and applying an electrical motion signal to said second end of the motion detecting unit housing when motion is detected, said motion detection means being powered by said battery;

said first end of the motion detecting unit housing being adapted for physical and electrical connection to the second end of the, other housings and said second end of the motion detecting unit housing being adapted for physical and electrical connection to the first end of all other housings to make battery power available to said motion signal to said alarm unit; and means for energizing said bulb and buzzer to provide an alarm signal in response to application of said motion signal to the alarm unit.

* * * * *